United States Patent [19]

Lelah

[11] Patent Number: 4,763,674

[45] Date of Patent: Aug. 16, 1988

[54] METHOD AND DEVICE FOR CONTROLLING HYDROGEN CYANIDE AND NITRIC OXIDE CONCENTRATIONS IN CIGARETTE SMOKE

[75] Inventor: Michael D. Lelah, Wilmington, Del.

[73] Assignee: Hercules Incorporated, Wilmington, Del.

[21] Appl. No.: 852,482

[22] Filed: Apr. 16, 1986

[51] Int. Cl.[4] ..... A24D 3/16

[52] U.S. Cl. ..... 131/342; 131/331; 131/332; 131/343; 493/47; 493/49

[58] Field of Search ..... 131/334, 331, 344, 342; 493/47, 49

[56] References Cited

U.S. PATENT DOCUMENTS

| | | | |
|---|---|---|---|
| 3,368,566 | 2/1968 | Avedikian | 131/334 |
| 3,403,690 | 10/1968 | Horsewell et al. . | |
| 3,405,717 | 10/1968 | Berger et al. | 131/344 |
| 3,407,820 | 10/1968 | Westcott | 131/342 |
| 3,428,055 | 2/1969 | Sublett et al. | 131/342 |
| 3,428,056 | 2/1969 | Sublett et al. | 131/342 |
| 3,434,479 | 3/1969 | Till et al. . | |
| 3,515,580 | 6/1970 | Eastes . | |
| 3,605,759 | 9/1971 | Owens . | |
| 3,618,619 | 11/1971 | Krefer . | |
| 3,631,539 | 1/1972 | Massa . | |
| 3,635,226 | 1/1972 | Horsewell . | |
| 3,695,937 | 10/1972 | Rowlette . | |
| 3,800,676 | 2/1974 | Levers et al. . | |
| 3,852,007 | 12/1974 | Levers et al. . | |
| 4,246,910 | 1/1981 | Rainer et al. . | |
| 4,266,561 | 5/1981 | Litzinger . | |

FOREIGN PATENT DOCUMENTS

| | | |
|---|---|---|
| 45-7055933 | 8/1970 | Japan . |
| 1397678 | 4/1973 | United Kingdom . |

*Primary Examiner*—V. Millin

*Attorney, Agent, or Firm*—John E. Crowe

[57] ABSTRACT

Method for reducing normal concentrations of hydrogen cyanide and/or nitrogen oxide by-products in cigarette smoke, by using, as garniture feed for a cigarette filter rod-making apparatus, one or more substrates, one or more surfaces thereof being treated by applying thereto an effective amount of at least one of (A) a solution, emulsion or dispersion of at least one of sodium bicarbonate, sodium carbonate, potassium permanganate, manganese dioxide in a nonionic spin solution;

(B) glycerol triacetate;

and corresponding filter element and cigarette utilizing a filter formed of such substrate(s).

18 Claims, 2 Drawing Sheets

Figure 1:
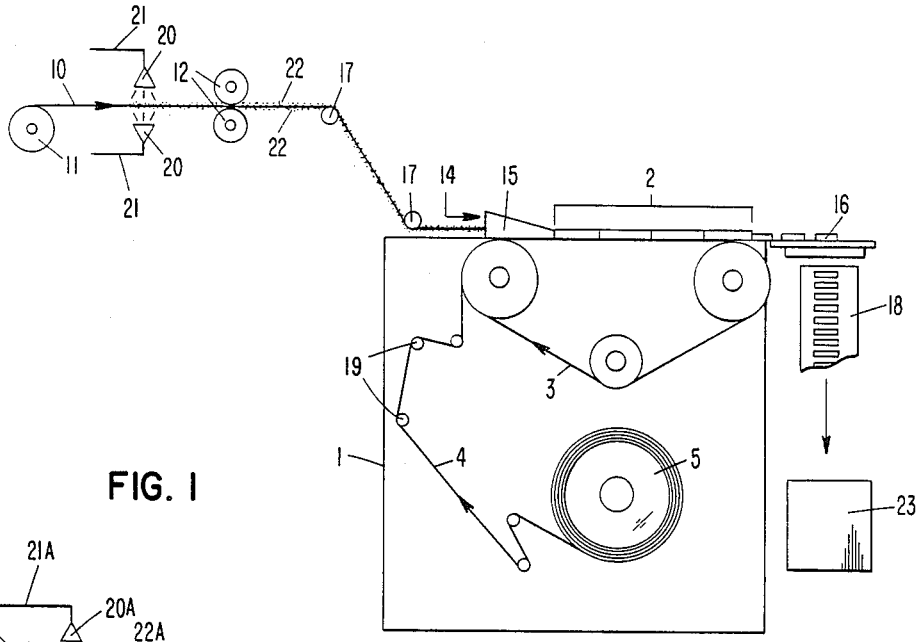

METHOD AND DEVICE FOR CONTROLLING HYDROGEN CYANIDE AND NITRIC OXIDE CONCENTRATIONS IN CIGARETTE SMOKE

The present invention relates to an improved method and corresponding filter element for reducing normal concentrations of hydrogen cyanide and nitrogen oxide by-products found in cigarette smoke by use of a filter element from a filter rod-making apparatus, employing, as garniture feed, at least one specially treated fiber containing substrate.

BACKGROUND

While fiber based filter elements are well-known and have been used in the cigarette manufacturing field for at least 40 years, the choice of fiber-candidates for such filters has remained quite limited over the years, due to cost factors and lack of general suitabillity of many natural fibers for high speed production using art recognized filter rod-making apparatus. In addition, the functional demands on filter elements in the market place are strongly conflicting with respect to characteristics such as pressure drop, filter efficiency, resiliency and hardness.

While various synthetic fiber and fiber mixtures have been tried and evaluated in the market place, the largest number of cigarette filter elements continue to include cellulose acetate-based fibers.

Although cellulose acetate fiber filter elements are generally not as efficient as elements containing finer denier synthetic fibers such as polyolefins or mixtures thereof, there remain substantial cost and handling advantages in using such fiber filter elements. For example, cellulose acetate tow is relatively inexpensive and can be easily and rapidly processed into cuttable filter rods using commercial, state-of-the-art filter rod-making apparatus without causing serious jamming problems. This advantage is enjoyed despite the normal application of substantial amounts of non-volatile liquid organic plasticizers such as triacetin, diacetin, citric acid and the like onto garniture feed such as fiber tows. For such purpose, plasticizers are usually dipped or sprayed onto the open moving fiber tow, the droplets being absorbed to form random softened areas capable of adhering to adjacent fibers. Such bonding of randomly-arranged fibers through use of plasticizer is intended to impart sufficient rigidity to the resulting filter rod to permit high speed cutting to obtain unwarped filter tip-length elements.

The above-stated advantages of cellulose acetate fiber, however, are countered by several disadvantages. For example, cellulose acetate fibers are weak (1.0–1.2 g./denier) compared with synthetic fibers such as polyolefins. This characteristic seriously limits the amount of tension and/or crimp which can be applied to the fiber tow feed prior to introduction into a filter rod-making apparatus.

Synthetic fibers, particularly polyolefins such as polypropylene, as noted above, are easily drawn to a much smaller denier, offering improved filter efficiency without simultaneous loss of strength needed for crimping and high speed production. Such fibers, however, also have disadvantages. These stem mainly from the fact that a substrate, such as an open or bloomed tow is relatively inert and not readily wetted or softened by most adhesive/plasticizer or other hydrophilic-type modifier formulations.

Another substantial problem, unique to the cigarette fiber filter art, concerns a recognized difficulty in optimizing fiber denier, filter element efficiency and pressure drop without corresponding sacrifice in dimensional stability, resiliency and hardness of the resulting filter element. In particular, polyolefin fiber-containing substrates (i.e. particularly tows and slivers) fed into a filter rod-making apparatus have demonstrated a significant negative correlation between pressure drop (resistance to draw) and dimensional stability or hardness of the filter element. In addition, it is often very difficult to avoid jamming of heavily impregnated polyolefin or other synthetic substrates fed at high speed into a conventional filter rod-making apparatus, particularly substrates containing substantial amounts of modifier components such as adhesives, humectants, flavors, medicines, absorbents, adsorbents, and the like, into or onto the garniture feed. This is due, in part, to an inherent deficiency in lubricating properties of many additive compositions used in the cigarette filter art.

It is an object of the present invention to efficiently and precisely disseminate and fix active modifier components or compositions within cigarette filter elements for control and selective removal of certain toxic by-products normally within cigarette smoke.

It is a further object of the present invention to selectively remove or control the concentration of one or more toxic gas components within cigarette smoke.

It is a still further object of the present invention to control the concentration of hydrogen cyanide and nitrogen oxide within cigarette smoke through use of pretreated substrate(s) suitable as a high speed garniture feed for a conventional filter rod-making apparatus.

THE INVENTION

The above objects are obtained in accordance with the present invention by utilizing, as a filter element, the product of a fiber rod-making apparatus using, as garniture feed, at least one fiber-containing substrate, inclusive of a polyolefin- and a cellulose acetate-containing substrate, which is treated with an effective amount of at least one active modifier component comprising (A) one or more members within the group consisting of sodium bicarbonate, sodium carbonate, potassium permanganate, manganese dioxide, the above-listed salts being applied alone or in combination, dissolved or dispersed in a non-ionic spin solution such as an aqueous surfactant, to at least one substrate; and (B) a member within the group consisting of glycerol triacetate, the later component being preferably applied as a solution in water or alcohol, in effective amounts onto at least one substrate component as garniture feed.

Effective amounts of components (A) and (B) for purposes of the present invention comprise about 2%–10% and about 1%–10% by weight respectively.

The term "nonionic spin solution" is here further defined as one or more aqueous surfactants of about 0.1%–10% and preferably 0.5%–10% by weight of (1) a polyoxyalkylene derivative of a sorbitan fatty acid ester, (2) a monoester of a polyhydroxyalcohol, or (3) a diester of a polyhydroxyalcohol. Suitable surfactants include, for instance, ethoxylates, carboxylic acid esters, glycerol esters, polyoxyethylene esters, anhydrosorbitol esters, ethoxylated anhydrosorbitol esters, ethoxylated natural fats, oils and waxes, glycol esters of fatty acids, polyoxyethylene fatty acid amides, polyalkylene oxide block copolymers, and poly(oxyethylene-cooxypropylene).

The term "substrate" as used herein denotes a fiber-containing or fibrillated film-containing component as a garniture feed in a filter rod-making apparatus, including (a) a fiber tow, (b) a sliver, (c) a ribbon of a nonwoven material or (d) a web of fibrillated film, which may be introduced alone or in complete or partial register for insertion into the garniture.

Such garniture feed can usually include up to about four substrate components, with desired active components preferably individually applied onto one or both faces of selected substrates therein, the manner and number of faces treated depending upon the desired filter efficiency, taste, feel, hardness, and draw of the resulting filter element.

For purposes of the present invention, it is generally immaterial whether the garniture feed is fabricated, in situ, (i.e. immediately upstream of the garniture) or produced and stored before use. It is also found useful for present purposes to use one or more nonwoven fabrics of the same or different fiber composition and denier, particularly when not all of the substrates are used as a carrier or absorbing surface for the active modifier component(s).

When nonwoven fabric is used as one or more substrate components for garniture feed, it can usefully comprise up to about 100% and preferably 10%–100% by weight of staple polyolefin (mono-, bi-, or tri-component) fiber identified generally as staple polypropylene, or may consist of webs having filaments of mixed denier, or combination of fibers such as (a) polypropylene/polyethylene, polypropylene/polyvinylidene chloride, polypropylene/cellulose acetate, polypropylene/rayon, polypropylene/nylon, cellulose acetate/polyethylene, plasticized cellulose acetate, polypropylene/paper; or (b) polypropylene/polystyrene/polyethylene, and the like, in a preferred ratio of about (a) 10%–90%/90%–10% or (b) 10%–90%/45%–5%/45%–5% by weight of fiber, and as generally described, for instance, in U.S. Pat. No. 3,393,685.

Suitable fibrillated film as substrate component for use alone or in combination with other substrate components as garniture feed within the present invention are obtained, for instance, in accordance with components as disclosed in U.S. Pat. Nos. 4,151,886 and 4,310,594 (Yamazaki) and U.S. Pat. No. 3,576,931 (Chopra).

For present purposes, a conventional filter rod-making apparatus suitable for present purposes comprises a tow trumpet, garniture, shaping means, wrapping means, and cutting means in accordance with components and processes generally described, for instance, in U.S. Pat. No. 3,144,023 and U.S. Pat. No. 2,794,480. If desired, however, modifications can be made to permit in-situ or prior spraying, dipping, printing or other traditional application of one or more modifier components prior to formation of a filter plug, and preferably before drawing through a garniture.

By way of further example, baled sliver or other substrate can be prepared for use by continuous dip coating or by contact with one or more printing roll(s) fed from reservoir(s) of desired active component(s), followed by conventional drying steps effected by nip rolls, heated drying rolls, ovens, and the like, at temperatures generally within the range of about 70° C.–125° C.

Generally speaking, nonwoven material from fibers within a wide denier range can be obtained using art-recognized techniques. Preferably such material falls within a weight range of about 10–50 grams per $m^2$, and a ribbon width of about 4"–12" will generally assure successful passage through the garniture of a conventional filter rod-making apparatus at production speeds.

As above-indicated, the garniture feed may usually comprise up to about 4 or even more substrate components of identical or different weight, dimensions, bonding, absorption, fiber composition, and denier, and can be introduced wholly or partly in register into the garniture. For best results, however, one relatively lightly thermally bonded fabric, tow, sliver or fibrillated film in register with one, or between two nonwoven fabrics is found to offer a high degree of flexibility for adapting the resulting filter element to a variety of market needs, including cost, filter draw, and hardness parameters.

The inclusion of an additional low melting fiber such as polyethylene, combined with other polyolefin fiber as garniture feed is found useful (although not mandatory) for obtaining tow plugs of widely varying bonding and liquid absorption or adsorption properties.

Cost-wise, nonwoven ribbons are found especially useful since they permit the use of relatively cheap polyolefin webs of mixed denier and type, and simplifying the precise distribution of modifier components within a filter element without the need for abandoning the above-listed art-recognized techniques and equipment such as printing rolls and spray heads for coating one or more nonwovens, before forming a filter plug.

Supplemental components in addition to the above-defined active modifier components can also be employed such as, for instance, solutions, emulsions, suspensions or dispersions of one or more humectants generally exemplified by polyhydric alcohols such as glycerols, glycols, etc.; flavors and perfumes such as ketoses and polysaccharides, including wintergreen, spearmint, peppermint, cinnamon, fruit flavors, etc., and additives as otherwise found in U.S. Pat. No. 4,485,828; medicines, such as menthol and decongestants, etc.

Figure 3:
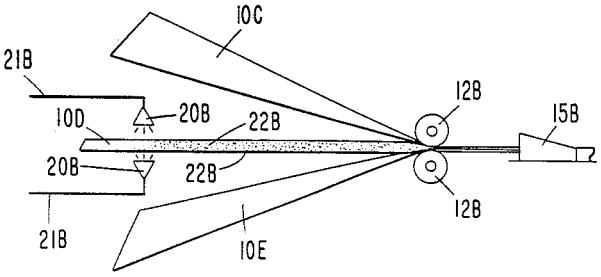

In order to maintain precise control over such additives, however, it is found useful if each treated substrate is dried to a moisture content of less than about 3% before conversion into filter elements. In addition, the filter element and its active additive components can be usefully shielded, as desired, from direct contact with the lips by applying the active component onto a tow, sliver or nonwoven fabric which is, in turn, sandwiched within two or more untreated nonwoven fabrics of lesser permeability (Ref. FIG. 3). In addition, the resulting filter element can be externally coated with cork or similar inert heat-insulating material (not shown). The amount and effectiveness of modifier(s) applied to filter elements in this way is determined substantially by the substrate width and number of substrates which are fed simultaneously into a garniture, as well as the amount of treated surface exposed to cigarette smoke in the filter element.

For present purposes, both treated and untreated fabric ribbon can be usefully wrapped using regular plug wrap paper having a weight within a range of about 25–90 g/$m^2$ or higher, as desired.

Figure 2:
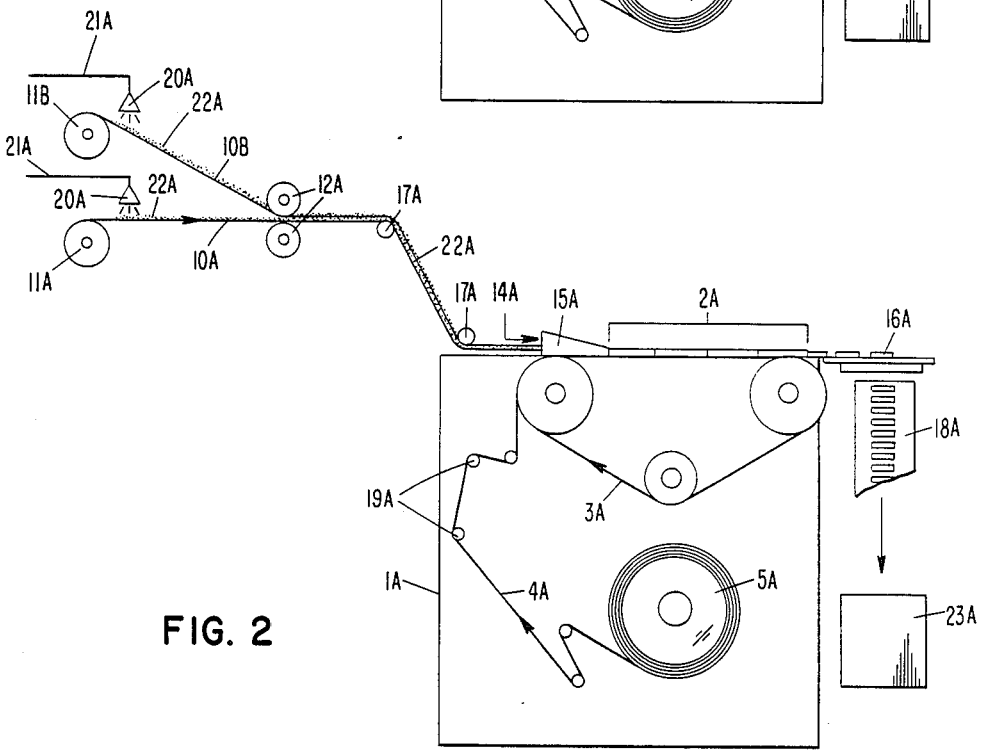

The instant invention is further illustrated in FIGS. 1–3, wherein

Figure 4:
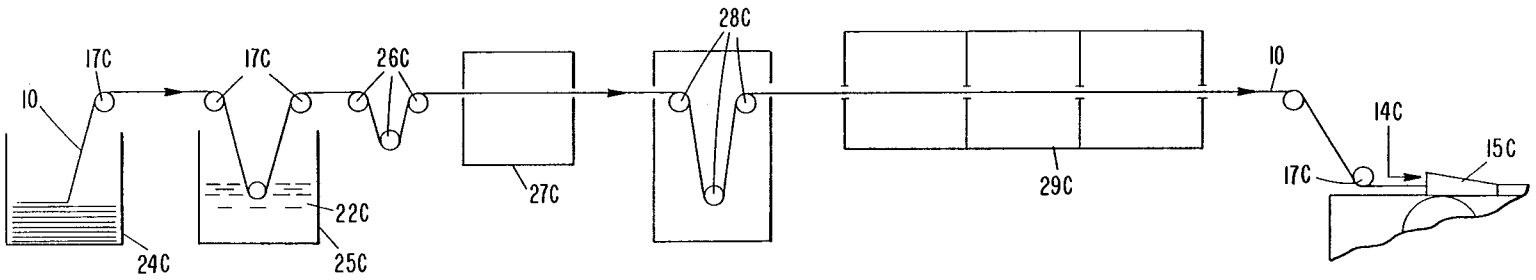

FIG. 1 diagrammatically represents a conventional cigarette filter rod-making apparatus modified to convert substrates prepared in accordance with the instant invention into filter elements, and FIGS. 2–4 diagrammatically represent further modifications and improvements within the instant invention, whereby one or more slivers ribbons of nonwovens or other substrates in register or partial register, are easily impregnated with one or more active modifier components by spraying or dipping and the use of multiple substrates favors increased filter element bulk and improved crush resistance, or hardness.

Referring to FIG. 1 in further detail, a single continuous substrate such as a fiber tow, sliver, fibrillated film or ribbon of nonwoven fabric (10) is fed from feed reel (11) or a bale (not shown) and through spray heads (20) feedably connected to feed lines (21) from outside sources (not shown) to apply separate active modifier components (22). The treated substrate (10) is then dried by air drying means (not shown) and by passing over drying rolls (12), to a desired degree of dryness, and led by guide rolls (17) into a garniture trumpet (15) and garniture (14) of a cigarette filter rod manufacturing apparatus (1) comprised of a garniture section (2) including (but not showing) means for shaping and retaining the substrate feed, wrapping means, and cutting means for converting the wrapped plug or rod into filter element (16); the wrapping means is conveniently supplied with tow wrap from wrap feed reel (5) supported by support rolls (19) and moved onto a continuous garniture belt (3) for introduction into the apparatus.

The apparatus, as described, comprises conventional means for sealing the tow wrap around a filter plug (not shown) which is cut by cutting means into cylindrical filter elements (16) of desired length (normally 90 mm), before removal by filter chute (18) (shown in fragment) for packing in container (23).

FIG. 2 diagrammatically demonstrates a further arrangement for separately applying active modifier component(s) onto a garniture feed or substrate whereby spray heads (20A) fed by connecting feed lines (21A) separately apply active modifier components (22A) (identical or otherwise) onto different substrates (10A, 10B), fed in register and dried using air and heated rolls (12A) before passage through garniture (14A) of rod-making apparatus (1A), to form filter elements (16A) as before. Substrates (10A and 10B), are fed from feed rolls (11A) and (11B) or bales (not shown) and conveniently brought into register at heated nip rolls (12A), then guided by guide rolls (17A) into garniture (14A), the garniture feed or substrate components shown being similarly defined by arabic numbers in each of FIGS. 1–3.

FIG. 3 diagrammatically demonstrates a further modification of the equipment and process of FIGS. 1 and 2, whereby several substrates of the same or different types (10C, 10D, and 10E) from reels or boxes (not shown) are fed through a nip created by heated rolls (12B), the middle substrate (10D) being of different width and preferably having higher absorption or adsorption properties for retaining active components (22B), then the two external untreated substrates (10C and 10E). As shown, substrate (10D) is sprayed on both sides to selectively expose it to one or more active modifier components (22B) applied by spray heads (20B) fed from feedlines (21B), one substrate (10E) preferably being wider and arranged so as to catch surplus drip or misdirected active components not retained or captured by ribbon (10D), all three substrates are then air dried by passing in register through heated nip rolls (12B), as before, and directed by guide rolls (not shown) into the garniture of a filter rod apparatus in the manner of FIGS. 1 and 2.

FIG. 4 is a diagrammatic representation of a further modification in which one or more substrates (not shown) can be separately fed from a bale or box (24C), passed over guide rolls (17C), and dipped into a reservoir (25C) containing active modifier component (22C), then passed through nip rolls (26C), through a heating oven (27C), through drawer rolls (28C) and a three step drying oven (29C), to garniture (14C) of a cigarette rod manufacturing apparatus in the manner of FIGS. 1–3, supra or boxed for future use.

Where a continuous fiber tow is used as a substrate component, preparation of the tow is conveniently carried out in the usual way by drawing the fiber from one or more creels through a fluid bulking or texturing jet and then handled as noted above.

Substrates which are employed in the above manner can usefully be of a variety of synthetic filaments as noted above. Thus, it is possible to use polyesters, polyamides, acrylics, as well as polypropylene or cellulose acetate materials. Due to its relatively low density, compared to other synthetic fiber-forming material and excellent spin properties, combinations of filament-forming copolymers of propylene with ethylene or other lower olefins monomers are preferred tow, ribbon and fibrillated film material.

The bulk denier of a tow for carrying out the present invention can conveniently fall between about 2,000 and 10,000. As noted above, this substrate can be supplied as a crimped fiber from a single creel or bale, or a composite of several creels or bales combined and passed through a fluid jet simultaneously. For best performance as cigarette filters, however, it is preferred that at least some of the tow be substantially untwisted and untexturized prior to entering a fluid jet.

The invention is further illustrated by the following Examples.

EXAMPLE 1

(A). Isotactic polypropylene staple fiber (4.5 dpf and 1.5" cut) having a "Y" cross section and a flow rate of 40±5 g/10 min., is carded into a web weighing about 0.18 grams per yd.$^2$. The web is transferred onto a continuous fiber-glass belt and lightly thermally bonded using a hot diamond-patterned calender at 140° C./40 psi roll pressure to obtain a nonwoven fabric which is die cut into 12 inch width test ribbon substrate hereafter identified as TS-1.

(B). Spun drawn 2.5 denier cellulose acetate yarn (circular cross section) obtained under conventional commercial spin conditions is unwound in parallel from a roll off creel under 0.01 g/denier tension and combined to form a fiber tow. The tow is then fed through a bulking jet using steam at 70 psi (107°–110° C.), the resulting spread tow substrate being hereafter identified as TS-2.

Compositions within the general definition of active modifier components (Finish Compositions A1–A6), and active modifier components B1–B2, supra, are applied as finish compositions to substrates TS-1 and TS-2 in the manner indicated in the Examples, the finish compositions used consisting of the following:

| Finish | | Compositions |
|---|---|---|
| A1 | 5 wt % | Sodium carbonate |
| | 5 wt % | Atmos TM 300*1 |
| | 5 wt % | Monolaurate ester of poly-oxyethylated sorbitol*2 |
| | 85 wt % | Water |
| A2 | 5 wt % | Sodium acetate |
| | 5 wt % | Atmos 300 |
| | 5 wt % | Tween 20 |
| | 85 wt % | Water |
| A3 | 5 wt % | Sodium bicarbonate |
| | 5 wt % | Atmos 300 |
| | 5 wt % | Tween 20 |
| | 85 wt % | Water |
| A4 | 5 wt % | Potassium permanganate |
| | 5 wt % | Atmos 300 |
| | 5 wt % | Tween 20 |
| | 85 wt % | Water |
| A5 | 5 wt % | Sodium bicarbonate |
| | 2.5 wt % | Atmos 300 |
| | 2.5 wt % | Tween 20 |
| | 90 wt % | Water |
| A6 | 5 wt % | Sodium bicarbonate |
| | 0.25 wt % | Atmos 300 |
| | 0.25 wt % | Tween 20 |
| | 94.5 wt % | Water |
| B1 | 1 wt % | Glycerol triacetate |
| | 5 wt % | Atmos 300 |
| | 5 wt % | Tween 20 |
| | 89 wt % | Water |
| B2 | 5 wt % | Glycerol triacetate |
| | 5 wt % | Atmos 300 |
| | 5 wt % | Tween 20 |
| | 85 wt % | Water |

*1Nonionic surfactant commercially obtained under this mark from ICI Americas.
*2Commercially obtainable under the mark Tween 20 TM from ICI Americas.

EXAMPLE II

A. A twelve inch (12") wide ribbon of continuous nonwoven polypropylene material (TS-1) from Example I is roll dipped into a bath of A1 finish in the general manner shown in FIG. 4, passed through heated nip rolls, oven dried, and hand rolled to form a filter rod of standard width which is cut into 27 mm filter elements (0.18 g and 24.35 mm circumference) identified as F-1 for testing purposes.

B. A twelve inch (12") wide ribbon continuous nonwoven material (TS-1) is hand rolled as in Example I, but without the dipping or drying steps of Example II A. The resulting filter rod is then cut into 27 mm (0.18 g) lengths, as before, and hereafter identified as FC-1 for control testing.

*3. Set up under hood.

C. A filter testing device(*3) comprising a valved constant pressure $HCN/N_2$ gas source is flowably secured on the down stream side by glass and Tygon tubing to a plastic filter holder which is connected, on its downstream side, to a Drager Tube(*4) packed with $HgCl_2$ and methyl red indicator for HCN colormetric determinations.

*4. Obtained from National Drager Inc., Pittsburg, Pa.

D. Filter elements obtained from the F-1 and FC-1 nonwoven ribbons are tested for HCN removal by mounting representative filter elements and passing an HCN/nitrogen gas mixture (100 ppm HCN) through the test filter elements at the rate of 50 ml/minute for a period of twelve (12) minutes per test. Test results are reported in Table I infra.

EXAMPLE III

Example II A–D. are repeated using the A2 and A3 finishes as active modifier components with corresponding controls. The samples, identified as F-2, F-3, FC-2 and FC-3 are tested using a Drager Tube as described in Example II and the results reported in Table I.

EXAMPLE IV

Test filter elements are prepared using a twelve inch (12") crimped tow web of plasticized cellulose acetate, of 2.5 dpf circular cross section, dipped into A4 finish, dried, hand rolled in the manner of Examples II and III and a 27 mm cut filter element tested for HCN removal, using the same Drager Tube as before. Test results are reported in Table I as G-1 and GC-1.

EXAMPLE V

Camel light tobacco rods are paper wrapped to 27 mm test filter elements obtained by dipping (30 seconds) twelve inch (12") crimped fiber tows comprised of 4.5 dpf polypropylene fiber ("y" cross section) into A5 and A6 finishes respectively, then air dried and passed through a standard filter rod making apparatus. Five test filter cigarette of each are smoked on a Borg-waldt smoking machine(*5) and the mainstream gasses analyzed for HCN, using the Drager tube as before. The average results are reported in Table I as C-1 and C-2 with controls CC-1 and CC-2 respectively.

*5. Eight two-second puffs (35 ml).

TABLE I

| Sample | Flow Rate ml/minute | Modifier Component | Time*7 | % HCN Removed |
|---|---|---|---|---|
| F-1 | 50 | A1 | 12 | 100 |
| FC-1*6 | 50 | — | 12 | 0 |
| F-2 | 50 | A2 | 12 | 96 |
| FC-2*6 | 50 | — | 12 | 0 |
| F-3 | 50 | A3 | 12 | 100 |
| FC-3*6 | 50 | — | 12 | 0 |
| G-1 | 50 | A4 | 12 | 100 |
| GC-1*6 | 50 | — | 12 | 0 |
| C-1 | 35 | A5 | 8 | 61 |
| CC-1*6 | 35 | — | 8 | 0 |
| C-2 | 35 | A6 | 8 | 69 |
| CC-2*6 | 35 | — | 8 | 0 |

*6Controls
*7In minutes

EXAMPLE VI

Two twelve inch (12") of TS-1 nonwoven ribbons, as described in Example II B, are dipped into B1 and B2 finish compositions respectively, dried, hand rolled and cut to obtain 27 mm length filters as before. The test filters are individually tested, using the system described in Example II except that the Drager Tube is prepacked with a Cr(V1) catalyst and P,P1-diamino, m,m1-dimethoxy biphenyl as a color indicator for detecting residues of nitrous oxide (NO). The test gas contains 100 ppm NO in nitrogen gas, with exposure for 30 minutes at a 50 ml/minute flow rate. Test results for S-1 and S-2 including controls S-1C and S-2C are reported in Table II.

TABLE II

| Sample | Flow Rate ml/minute | Modifier | Time | % NO Removed |
|---|---|---|---|---|
| S-1 | 50 | B1 | 30 | 27 |
| S-1C | 50 | — | 30 | 0 |
| S-2 | 50 | B2 | 30 | 39 |
| S-2C | 50 | — | 30 | 0 |

EXAMPLE VII

Two bulked polypropylene fiber tow substrates (TS-2) obtained from Example IB are separately sprayed to saturation with A2 and B2 finish compositions using the modified apparatus described schematically in FIG. 2, then air- and roller-dried, and the tow introduced into the garniture of a filter rod-making machine as described in Example II. Randomly chosen 27 mm filter elements obtained thereby (average weight of 0.18 g) are then tested for NO and HCN removal. The test results are found comparable to those reported in Table I using A2 and in Table II using B2 modifiers.

What I claim and desire to protect by Letters Patent is:

1. A method for selectively removing or controlling toxic gas components within cigarette smoke, comprising utilizing, as a filter element, the product of a filter rod-making apparatus using at least one polyolefin fiber- or film-containing garniture feed treated with an effective amount of at least one active modifier component of the group sodium carbonate, potassium permanganate and manganese dioxide; said active modifier component being dissolved or dispersed in a non-ionic spin solution and glycerol triacetate.

2. The method of claim 1 wherein the modifier components are applied to separate substrate surfaces, and said substrate comprises at least one of (a) an open fiber tow, (b) a sliver, (c) a ribbon of nonwoven material or (d) a web of fibrillated film.

3. A filter element obtained in accordance with the method of claim 2.

4. A cigarette comprising a tobacco rod in serial combination with a filter obtained in accordance with claim 3.

5. The method of claim 1, wherein modifier components are applied to opposite sides of a polyolefin-containing substrate.

6. A filter-element obtained in accordance with the method of claim 5.

7. A cigarette comprising a tobacco rod in serial combination with a filter obtained in accordance with claim 6.

8. The method of claim 1, wherein the modifier components are separately applied to different substrates by dipping or spraying.

9. A filter element obtained in accordance with the method of claim 8.

10. A cigarette comprising a tobacco rod in serial combination with a filter obtained in accordance with claim 9.

11. A filter element obtained in accordance with the method of claim 1.

12. A cigarette comprising a tobacco rod in serial combination with a filter obtained in accordance with claim 11.

13. A method for selectively removing or controlling toxic gas components within cigarette smoke, comprising utilizing, as a filter element, the product of a filter rod-making apparatus using at least one polyolefin fiber- or film-containing garniture feed treated with an effective amount of at least one active modifier component selected from the group consisting of sodium carbonate, potassium permanganate and manganese dioxide; said active modifier component being dissolved or dispersed in a non-ionic spin solution of a member selected from the group consisting of a fatty acid monoester and a fatty acid diester of a polyhydroxy alcohol.

14. The method of claim 13 wherein polyolefin-containing substrate is pretreated by corona or plasma discharge before application of active modifier component.

15. The method of claim 13, wherein the garniture feed is a nonwoven material in combination with at least one other substrate.

16. A filter element obtained in accordance with the method of claim 15 in which the other substrate is in complete or partial register for insertion into a garniture.

17. A filter element obtained in accordance with the method of claim 13.

18. A cigarette comprising a tobacco rod in serial combination with a filter obtained in accordance with claim 7.

* * * * *